United States Patent [19]

Schoeman

[11] Patent Number: 4,624,076

[45] Date of Patent: Nov. 25, 1986

[54] DOOR OPENER

[76] Inventor: Johannes F. Schoeman, P.O. Box 4322, Bloemfontein, South Africa

[21] Appl. No.: 744,577

[22] Filed: Jun. 14, 1985

[30] Foreign Application Priority Data

Jun. 18, 1984 [ZA] South Africa ..... 84/4577
Jul. 23, 1984 [ZA] South Africa ..... 84/5662
May 28, 1985 [ZA] South Africa ..... 85/4023

[51] Int. Cl.[4] ..... E05F 11/00

[52] U.S. Cl. ..... 49/199; 49/200; 49/359

[58] Field of Search ..... 49/199, 200, 358, 359; 160/189

[56] References Cited

U.S. PATENT DOCUMENTS 2,602,664 7/1952 Matchett ..... 49/199 X
3,436,862 4/1969 Stansberry ..... 49/358
3,591,981 7/1971 Law ..... 49/199 X

FOREIGN PATENT DOCUMENTS 2311488 5/1975 France ..... 49/199

*Primary Examiner*—Kenneth Downey
*Attorney, Agent, or Firm*—Berman, Aisenberg & Platt

[57] ABSTRACT

An opening mechanism for a tip-up door especially for garages which comprises levers fixed on a shaft which is mounted hingedly on the door, the levers having their distal ends connected to the door frame and torque applying structure being functionally connected with the shaft and a motor to apply torque for opening the door with the structure and motor being mounted on the door. The torque applying structure can be a crank or a gear system. An initiator can comprise either a manually applied switch or remote initiating means such as ultra-sonic or radio signals. This opening mechanism applies a torque to the levers to lift the door open in a tip-up action but additionally applies a reaction torque to the door itself to swing it up in the typical tip-up fashion while the levers lift it.

13 Claims, 9 Drawing Figures

DOOR OPENER

BACKGROUND OF THE INVENTION

1. Field of the Invention

This invention concerns improvements in and relating to door openers, that is mechanism which can be used for opening of doors, in particular, doors of the type which are commonly described as "tip-up" doors such, for example, as are commonly used for garages or similar large openings.

The invention is applicable to this kind of door mechanism adapted for tip-up opening of a door by running in vertical channels also with the channels adapted to operation in other orientations in space, for example, horizontally.

2. Description of the Related Art

Tip-up doors typically comprise rollers provided at an intermediate height of the left hand and right hand vertical sides of the door to run in vertical channels in the door frame and link or other type mechanisms to control a "tip-up" action whereby the door rotates from a vertical position to a horizontal position when it is opened by lifting it upwards, generally with means of counterbalancing the weight of the door. Motor driven opening of such doors has been described in arrangements where a motor is mounted on fixed structure and drives levers or cables or screws to actuate the door for opening and closing.

SUMMARY OF THE INVENTION

A door opener in accordance with this invention comprises at least one lever hingedly mountable on a door, distal end(s) of the lever(s) adapted for connection to a door support structure, proximal end(s) of the lever(s) fixed to a shaft which is rotationally mountable on the door, torque applying structure functionally connected with the shaft and an actuator, which structure and actuator are mountable on the door.

Thus because the torque applying structure and the actuator are mounted on the door, in addition to torsionally actuating the levers for tipping up of the door they apply, by virtue of the inevitable equal and opposite reaction, a torque on the door turning it in the required direction for the tip-up movement.

In the preferred embodiment of the invention two levers are mounted on the shaft which is mountable on the door, the shaft adapted to extend across the width of the door, the levers and first distal ends being located at the opposite sides of the door, each lever extending from the shaft to the first distal end.

Here again it must be mentioned that the use herein of terms such as "width" implying a particular orientation of the door in use are to be construed appropriately if the door is to be used in another orientation of use.

The employment of such a shaft extending across the width of the door makes it possible for the levers to work on either side of the door, adjacent door supporting structure, for example, a door frame.

In another embodiment of the invention a lever is mounted on a shaft which is mountable on the door and adapted to extend from the torque applying structure next to the side of the door where the lever extends to the distal end working on one side of the door only.

In one preferred embodiment of the invention the torque applying structure comprises a crank oppositely directed to the lever(s) which crank is connected to the actuator.

The actuator will apply an actuating force to the crank which by virtue of the hinged mounting of the shaft on the door becomes a torque applied to the lever(s) which in turn, with the distal ends of the lever(s) attached to supporting structure actuates tipping up of the door.

For example, the actuator may be a motor, the torque applying structure a motor-driven screw working in a nut pivotally fixed in the distal end of the crank.

However, in another embodiment the torque applying structure comprises a gear train and the actuator a motor.

In principle, however, the actuator need not be a motor having rotary motion but an actuator having some kind of linear action, such as a linear motor, a pneumatic or hydraulic piston and cylinder, a solenoid or other. The control of the operation is preferably by the use of an initiator which will receive a control signal at least for providing the initiation and continuation of action of the actuator and the termination of actuation can conveniently be controlled by use of limit switches or other means operating on a similar principle to stop the tipping up of the door when it reaches the required position and vice versa when closed.

The actuator can, in another preferred embodiment, additionally comprise springs connected directly or indirectly with the lever(s) and tensioned to apply a torque to the lever(s) or shaft which counteracts the effect of the weight of the door. The weight of the door acts to tend to cause the door to close. The springs can be helical tension springs, helical torsion springs and/or spiral springs, for example.

As stated above the actuator is mounted on the door and this is so where the spring(s) constitute the actuator as well as a motor.

Preferably some means of disconnection of the opener is provided for convenience and quick disconnection when the door has to be tipped up manually, for example.

BRIEF DESCRIPTION OF THE DRAWINGS

The invention will now be more fully described by way of examples with reference to the accompanying drawings, in which.

DESCRIPTION OF THE PREFERRED EMBODIMENTS

Figure 1:
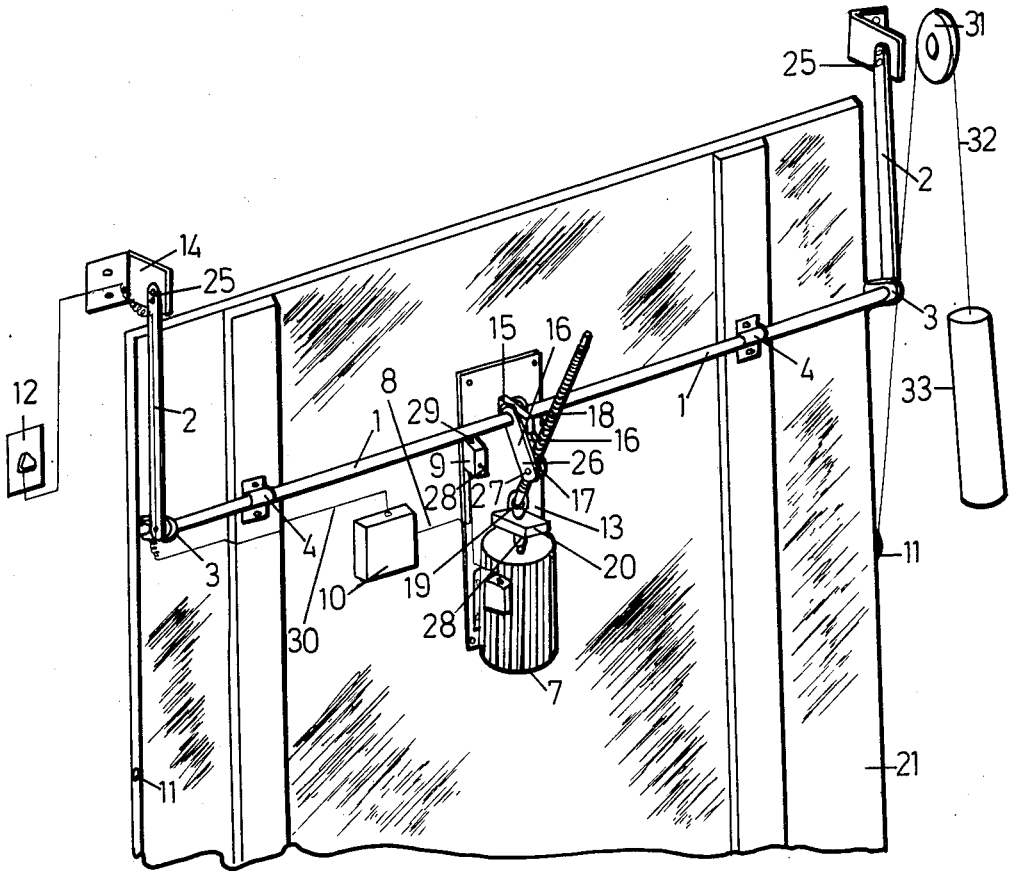
FIG. 1 is an oblique view of a door opener in accordance with the preferred embodiment of the invention, shown mounted on a door.

As shown in FIG. 1 the door opener comprises two levers 2 which are fixed irrotationally and at right angles to the opposite ends of a shaft 1, each arm 2 presenting a distal end 25 adapted for connection to a door supporting structure in a pivotal manner by means of brackets 14 which are part of or can be bolted onto the door frame or adjacent walls. Torque applying structure for applying torque to the levers 2 in this case via the shaft 1 is mounted on a plate 13 which is mounted in turn on the door 21. The levers 2 are hingedly mounted on the door by means of brackets 3, which are bolted or welded to the door and have holes through which the shaft 1 passes. Additional but not essential mounting brackets 4 are also provided.

The torque applying structure applies torque to the levers 2 when it is desired to tip up the door for opening and conversely for closing. The torque applying structure comprises oppositely directed cranks 16 which are fixed to the shaft 1 and have distal ends 26. At the distal end 26 a nut 17 is pivotally mounted by means of pin 27 and a screw 18 screws in the nut 17. The screw 18 is connected by means of a universal joint 19 to the shaft 22 of an electric motor 7, a mounting plate 20 being provided for support of the shaft 22. The motor 7 is fixed on the plate 13. A mounting 15 provides support for the shaft 1 to stabilise the shaft 1 in the position where the forces are applied by means of the screw 18 to create the torque for opening or closing the door. The motor 7 then constitutes the actuator of the door opener, and the screw 18 and cranks 16, the torque applying structure.

An initiator 9 is provided for control of the door opener and carries a latching circuit by means of which relay switch 28 is actuated or de-actuated for either opening or closing of the door. The initiator can be actuated either by pressing the push button 61 or by a signal from the remote receiving apparatus housed in box 10 for remote opening or closing of the door. Furthermore, a switch 29 is arranged to be actuated by cams on shaft 1, (not shown here), to terminate either the opening or closing of the door at the right position. The initiator thus controls supply of electric current to the electric motor 7 for rotation in either a clockwise direction for opening or anti-clockwise direction for closing or vice versa. A power cord proceeds from the box 9, via one of the arms 2, one of the brackets 14 to a power source, such as a wall receptacle as shown at plug 12.

The weight of the door is counterbalanced in a usual way, for example, using a pair of pulleys and weights with cables, such as is shown only on the right hand side, a pulley 31, cable 32 and counterweight 33. The same would be provided on the other side.

The radio signal to the radio receiver in the box 10 could be substituted for by any other suitable means of remote signalling, for example, an ultrasonic signal, an infra red signal, a radar signal or other as required.

Figure 2:
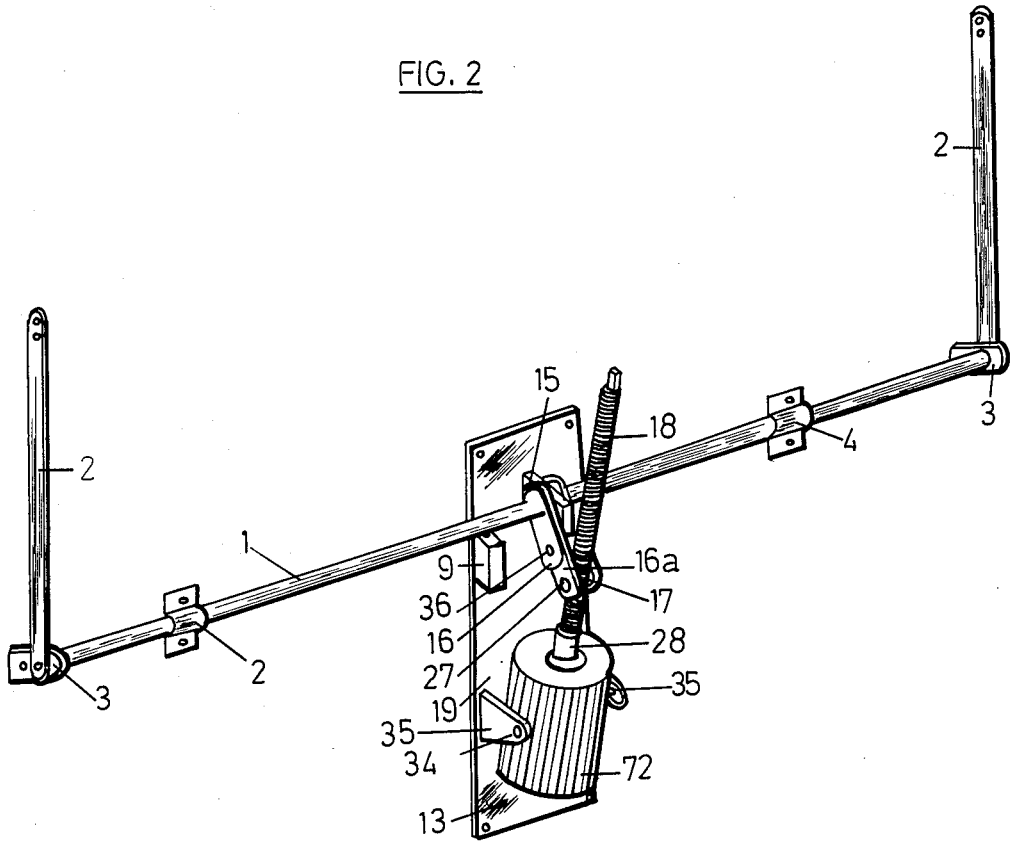
FIG. 2 is a similar view of a door opener in accordance with another embodiment of the invention.

As shown in FIG. 2 a door opener which is similar in other respects could have the motor 7*a* not rigidly fixed to the base plate 13 but pivotally mounted by means of pins 34 (35) forming a yoke type mounting of the motor. In this case the shaft 22 of the motor may be connected directly to the screw 18 in a rigid connection, thereby obviating the need for a universal joint.

FIG. 2 shows a further advantageous arrangement where, in addition to the cranks 16 which are welded to the shaft 1 an additional pair of cranks 16*a* is provided which are merely pivotally mounted on the shaft 1 and which carry the nut 17 through which the screw 18 screws. In order to provide a connection thus between the actuator and the shaft 1 a pin 36 is provided which may be passed through matching holes in the cranks 16 and the cranks 16*a* thereby providing the connection. It may be noted that with the pin 36 in position the door will be held in its closed position by the door opener which is, of course, important from the point of view of security. However, if the motor fails or the electric power fails the pin 36 can be removed in this embodiment and then the door can be opened manually resulting in the cranks 16 pivoting freely and without any connection to the cranks 16*a* or the screw 18.

Figure 3:
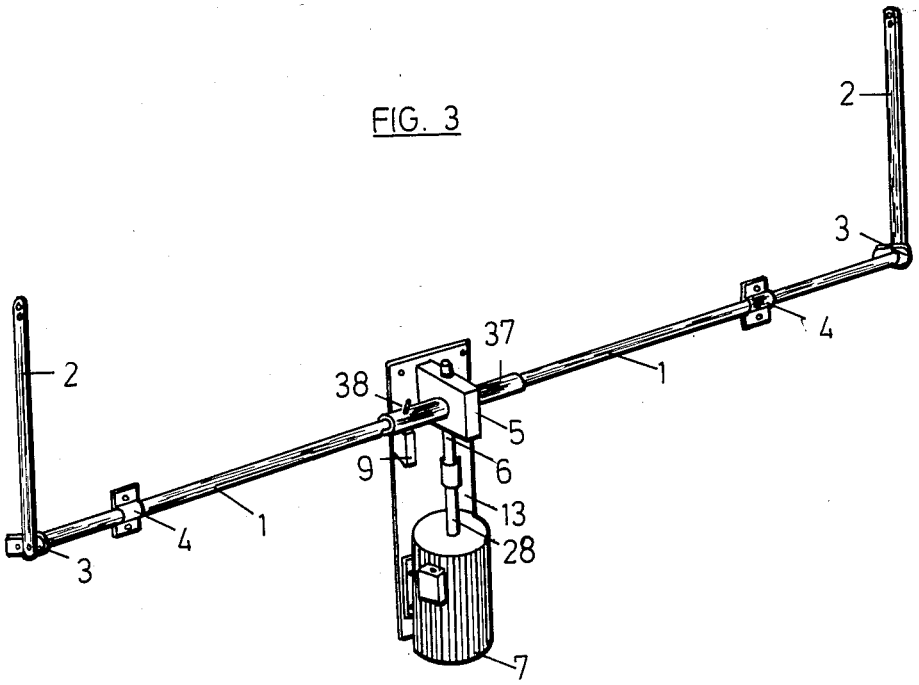
FIG. 3 is a similar view of a door opener in accordance with yet another embodiment of the invention.

An alternative arrangement could be to use some of the structure shown in FIG. 3, that is to mount the cranks on a tube as the tube 37 (FIG. 3) through which the shaft 1 passes. By removing the pin 38 which rotationally locks the tube 37 and the shaft 1 together, the door can also be manually opened.

As shown in FIG. 3 the cranks 16 can be dispensed with and instead a toothed spur wheel mounted on a tube 37. The shaft 22 of the motor will then in this case be connected directly to a shaft 6 which enters a gearbox 5, the shaft 6 carrying a worm gear which meshes with the toothed wheel which is mounted on the tube 37. The tube 37 is again provided with a pin 38 which is normally passed through holes in the tube 37 and the shaft 1 so as to rotationally lock the tube and the shaft together. Thus the drive from the motor 7 will drive the worm gear on the shaft 6 which in turn will drive the tube 37 and shaft 1 to actuate the door opener. Again other components may be as described in previous figures and the same reference numerals are used for corresponding parts.

The pin 38 in this example then serves the same purpose as the pin 36 described with reference to FIG. 2, permitting disconnection of the actuator with the other parts so that the door can be opened manually if there is a power failure or for any other reason.

In this embodiment whereas a two direction electric motor may again be employed the option is available of adapting the gear box 5 to provide for the rotation of the shaft in two directions, one for opening and one for closing thereby permitting the use of a one direction motor.

It is also clearly possible to use a gearbox which provides for the shafts 6 and 22 to be aligned parallel with the shaft 1 instead of at right angles to it as shown in FIG. 3. The motor 7 would then be appropriately mounted with its shaft parallel to the shaft 1 and alongside the shaft 1. The mechanism would still operate in the same way in principle.

Figure 4:
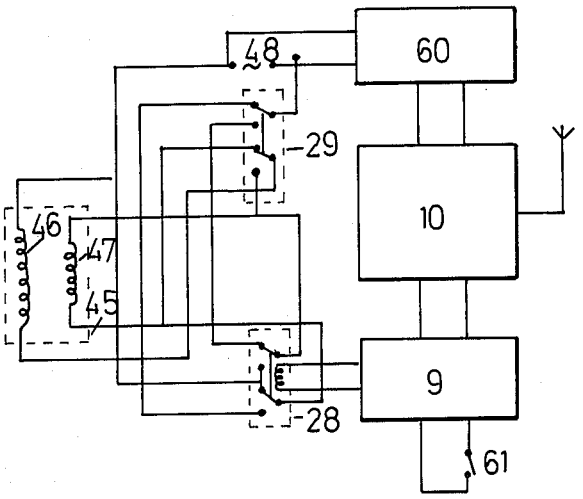
FIG. 4 is a circuit diagram suitable for an A.C. motor, and FIG. 5 a circuit diagram suitable for a D.C. motor.
Figure 5:
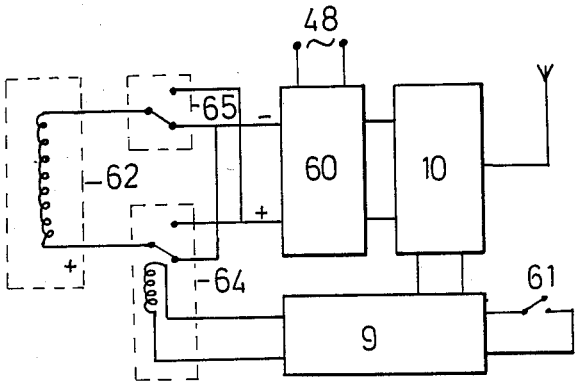

Electrical circuitry is shown in FIGS. 4 and 5. The A.C. motor, indicated by broken lines 45 in FIG. 4, has a field coil 46 and armature coil 47. The switch 29 and the relay switch 28 are included in the circuitry in the manner shown. Both switches are double pole double throw switches, in the manner shown and the power supply, for example, 220–250 volts A.C. or any other A.C. power supply is at 48.

FIG. 5 shows another arrangement of a circuit diagram suitable for a bidirectional D.C. motor 62, changing its direction by reversing the polarity of its power supply. Switch 65 is single pole double throw switch fulfilling the same function as switch 29 (FIG. 4) while switch 64 is a single pole double throw relay, fulfilling the same function as relay 28 (FIG. 4). The other parts with the corresponding references also fulfill the same functions except that the power for the D.C. motor also comes from the power supply.

An examination of the circuits shown in FIGS. 4 and 5 will confirm the effect of the arrangement is as follows:

Both switches up—motor off
29 or 65 up and 28 or 64 down—motor runs forward
Both switches down—motor off
29 or 65 up and 28 or 64 down—motor runs in reverse This arrangement can then be used to provide satisfactory control of the operation if suitably connected so that if the switch 28 FIG. 4 or 64 FIG. 5 is moved when the door is closed it initiates opening and when a cam (not shown) moves the switch 29 FIG. 4 or 65 FIG. 5 the opening is stopped and again if the switch 28 or 64 is then reactuated closing is initiated and continues until the door is closed when the switch 29 or 65 is again moved to stop the closing action. As stated above instead of the remote actuation of switch 28 or 64 by means of the radio receiver, actuation can also be initiated by pressing the push button 61.

Figure 6:
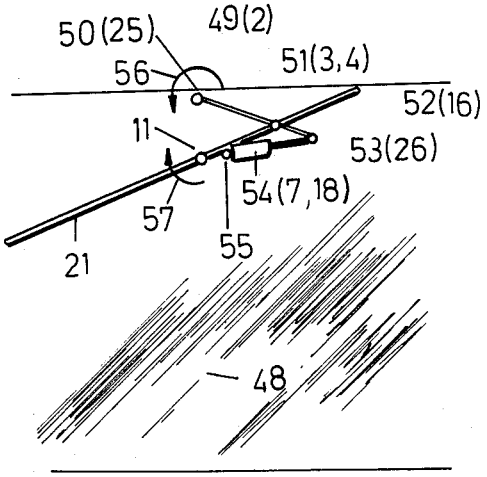
FIG. 6 is a schematic side elevation of the door opener mounted on a door showing operation.

FIG. 6 shows in side view in schematic drawing operation of the door. It is also useful for clarifying terminology used herein. Numerals in parentheses refer to the numerals used in FIGS. 1 to 3 for the corresponding parts. As will be seen the door 21 has rollers 11 which run in vertically arranged channels 48 (not shown in the drawings up to now) and the door opener comprises a lever 49 (2) which presents a distal end 50 (25) pivotally connected to the door frame, the lever being hingedly connected at 51 (3,4) to the door 21 and the lever further comprising a crank 52 (16) which presents a second distal end 53 (26) to which the actuator 54 (7,18) is connected. The actuator 54 is shown schematically and could comprise a pneumatical hydraulic piston and cylinder in principle or a motor and screw or motor and gearbox as described. The door is shown in FIG. 10 in an intermediate position of tipping up during which the actuator is lengthening the distance between the distal end 53 and the position 55 of connection of the actuator on the door. This therefore applies a torque to the lever in a direction indicated by the arrow 56 and at the same time applies a torque to the door 11 in a direction indicated by the arrow 57 and these two torques very effectively tip up the door for opening it. The closing of the door is the reverse situation. Thus although in principle the lever and crank could comprise only a single bar having the arms 49 and 52 this would require a hole through the door if the actuator is located in a central position in the door and thus it is preferred in fact to include the use of the shaft 1 so that the two levers (49) 2 at opposite ends of the shaft and the crank (52) 16 in the centre of the shaft, but the principle of operation is still the same as shown in FIG. 10.

Figure 7:
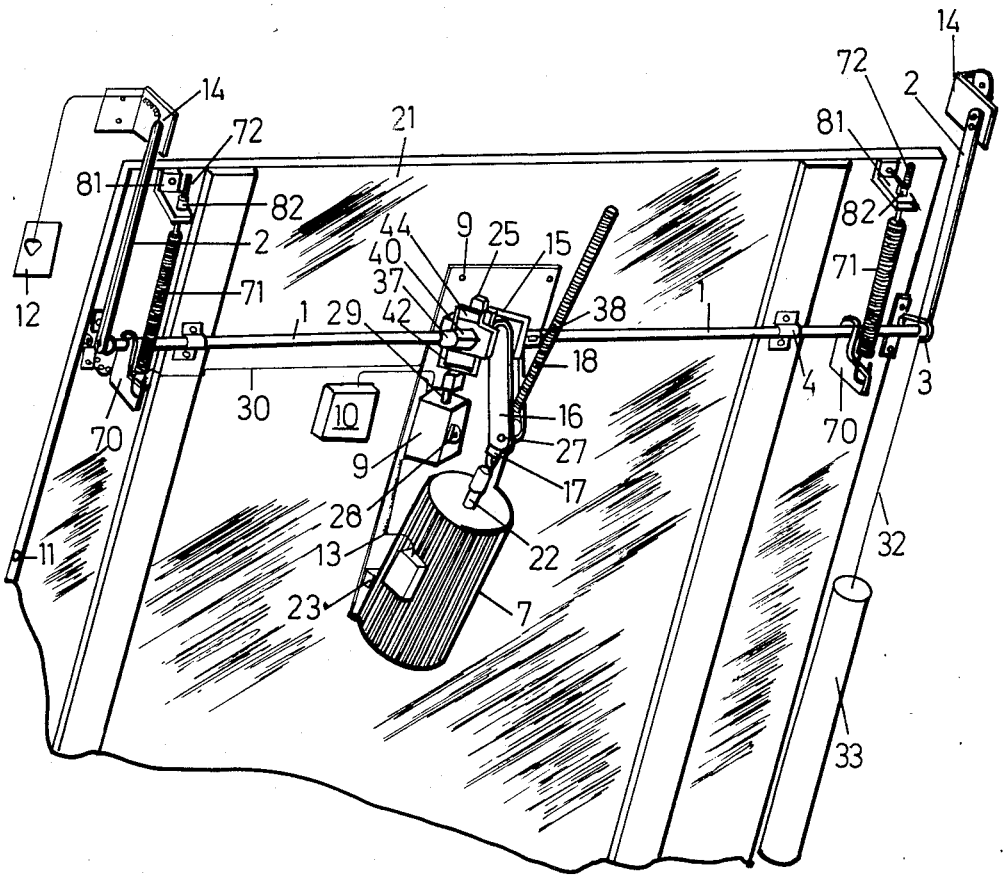
FIG. 7 is an oblique view of a door opener with spring counterbalancing using helical tension springs.

FIG. 7 shows the same structure as was shown in FIG. 2 and the same reference numerals have been used for corresponding parts, to which has been added springs to counteract door weight. Two helical tension springs 71 are connected at lower ends to spring-cranks 70 which are fixed to the shaft 1. The upper ends of the springs 71 are connected to screws 72 which pass through holes in brackets 81 which are fixed to the door 21. Nuts 82 screw on the screws 72 to permit adjustment of the spring tension. The springs constitute an actuator and the spring-cranks the torque applying structure of the claims. The springs are at maximum tension when the door is closed and the tension reduces when the door opens.

Figure 8:
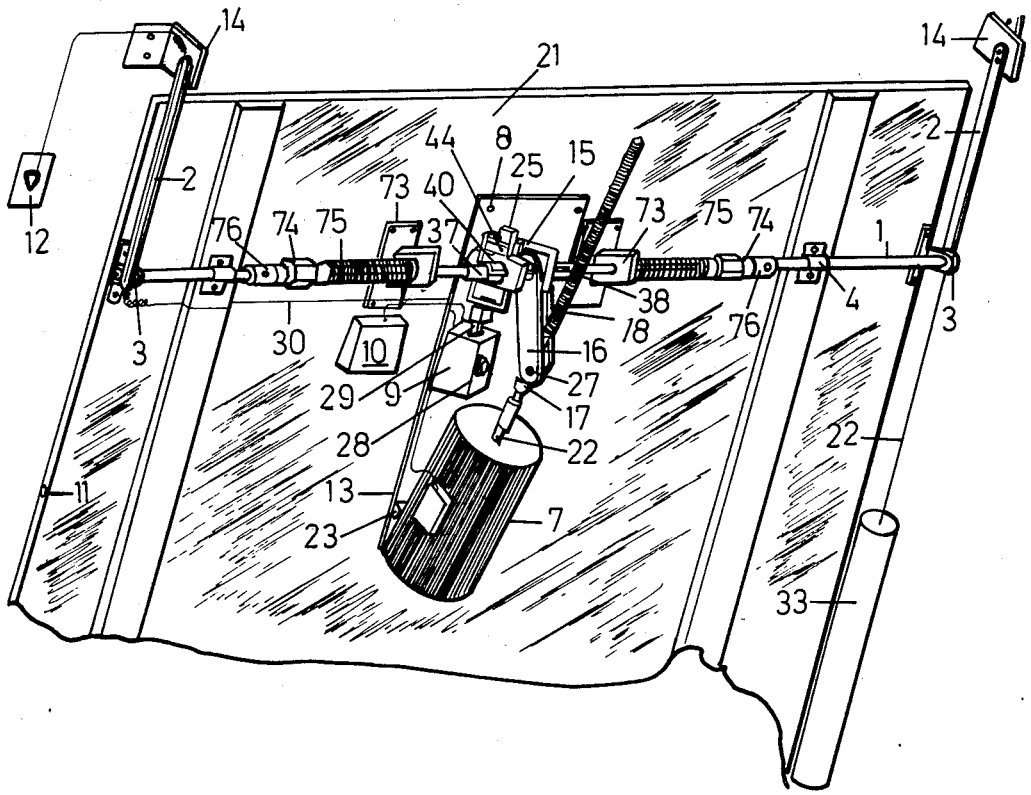
FIG. 8 is an oblique view of a door opener with spring counterbalancing using helical torsion springs.

FIG. 8 shows (analogously to FIG. 7) the use of helical torsional springs 75. The inner ends of the springs 75 are fixed to the door 21 via brackets 73 and the outer ends to the shaft 1 via adjustable connectors 74 and 76 to allow adjustment of spring tension. Bush 76 is fixed to shaft 1 and hexagonal (to permit rotation with a spanner) bush 74 is rotatable on shaft 1 but has ratchet-like teeth which engage matching teethon bush 76.

Figure 9:
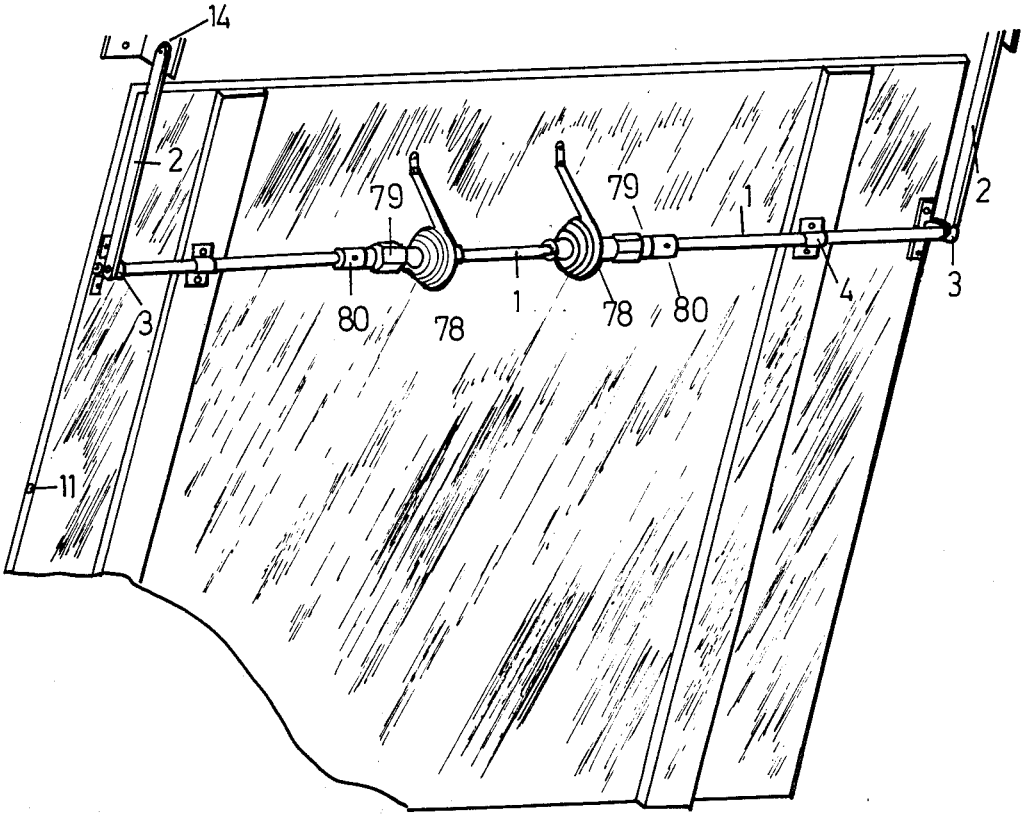
FIG. 9 is an oblique view of a door opener with spring counterbalancing using sprial springs.

FIG. 9, again analogously to FIG. 7, shows use of spiral springs 78 whose inner ends are fixed to the shaft 1 and outer ends are fixed to the garage door. Again tension adjustment is by bushes 79 and 80 which are the same as those described with reference to FIG. 8.

I claim:

1. A door opener which comprises two levers hingedly mountable on a door, distal ends of the levers adapted for connection to a door support structure, proximal end(s) of the lever(s) fixed to a shaft which is rotationally mountable on the door, torque applying structure functionally connected with the shaft and an actuator, which structure and actuator are mountable on the door.

2. A door opener as claimed in claim 1, in which the shaft extends across the width of the door, the levers and distal ends being located at opposite sides of the door, each lever extending from the shaft to the distal end.

3. A door opener as claimed in claim 1, in which the torque applying structure comprises a crank fixed on the shaft and a motor driven screw working in a nut pivotally fixed in the distal end of the crank and the actuator comprises a motor which drives the screw.

4. A door opener as claimed in claim 3, in which the motor has a drive axle which is rigidly connected to the screw and has a body which is pivotally mountable on the door.

5. A door opener as claimed in claim 1, in which the torque applying structure comprises a gear train and the actuator comprises a motor with a drive axle operatively connected through the gear train to the shaft.

6. A door opener as claimed claim 1, in which the actuator as a linear motor.

7. A door opener as claimed in claim 1, in which means of disconnection of the torque applying structure from the shaft is provided in the form of a withdrawable pin.

8. A door opener as claimed in claim 1, in which the actuator is a spring, one end of which is fixed to the door and the other end of which is functionally connected with the shaft by means of an adjustable connector.

9. A door opener as claimed in claim 1, in which the actuator is a solenoid.

10. A door opener as claimed in claim 1 in which the actuator is a pneumatic piston and cylinder.

11. A door opener as claimed in claim 1, in which the actuator is a hydraulic piston and cylinder.

12. A door opener as claimed in claim 1 for a "tip-up" door and in which the torque-applying structure comprises a crank fixed on the shaft and a motor-driven screw which works in a nut pivotally fixed in the distal end of the crank, and the actuator comprises a motor which drives the screw.

13. A combination of a door opener as claimed in claim 1 and a "tip-up" door wherein each lever is hingedly mounted on the door, distal ends of the levers are connected to door-support structure, proximal ends of the levers are fixed to a shaft which is rotationally mounted on the door, and the torque-applying structure and the actuator are mounted on the door.

* * * * *